US007681510B2

(12) United States Patent
Watanabe

(10) Patent No.: US 7,681,510 B2
(45) Date of Patent: Mar. 23, 2010

(54) EMBROIDERY FRAME FOR USE WITH EMBROIDERY SEWING MACHINE

(75) Inventor: Yasuhiro Watanabe, Tokoname (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 134 days.

(21) Appl. No.: 11/806,400

(22) Filed: May 31, 2007

(65) Prior Publication Data

US 2007/0277715 A1 Dec. 6, 2007

(30) Foreign Application Priority Data

Jun. 2, 2006 (JP) ..... 2006-154440

(51) Int. Cl.
*D05C 9/04* (2006.01)
*D06C 3/08* (2006.01)

(52) U.S. Cl. ..... 112/103; 38/102.91

(58) Field of Classification Search ..... 112/103, 112/470.14, 475.18; 38/102, 102.2, 102.91; 160/378, 383, 395, 397, 398
See application file for complete search history.

(56) References Cited

U.S. PATENT DOCUMENTS

| | | | | |
|---|---|---|---|---|
| 2,832,171 | A * | 4/1958 | Batey | 38/102.91 |
| 3,664,288 | A * | 5/1972 | Weidlin Von Boden et al. | 112/103 |
| 3,922,804 | A * | 12/1975 | Batey | 38/102.91 |
| 5,101,746 | A * | 4/1992 | Frye | 112/470.14 |
| 5,255,466 | A * | 10/1993 | Synder | 40/603 |
| 5,280,759 | A * | 1/1994 | Scholl | 112/470.07 |
| 5,293,704 | A * | 3/1994 | Brown | 38/102.9 |
| 5,427,043 | A * | 6/1995 | Conley et al. | 112/102.5 |
| 5,555,653 | A * | 9/1996 | Morgan | 38/102.2 |
| 5,561,927 | A * | 10/1996 | Blavat | 38/102.91 |
| 5,651,325 | A * | 7/1997 | Conley, Jr. | 112/470.14 |
| 6,223,665 | B1 * | 5/2001 | Hindsley | 112/117 |
| 6,679,190 | B1 * | 1/2004 | French et al. | 112/103 |
| 7,194,968 | B2 * | 3/2007 | Okazaki | 112/103 |
| 7,222,445 | B2 * | 5/2007 | Schmidt | 38/102.91 |
| 7,458,174 | B1 * | 12/2008 | Gustin et al. | 38/102.2 |
| 2006/0180064 | A1 | 8/2006 | Okazaki | |
| 2006/0180066 | A1 | 8/2006 | Okazaki | |
| 2007/0079741 | A1 | 4/2007 | Watanabe et al. | |

FOREIGN PATENT DOCUMENTS

| | | |
|---|---|---|
| JP | B2 60-4299 | 2/1985 |
| JP | A 08-238391 | 9/1996 |
| JP | A-11-061627 | 3/1999 |
| JP | A 11-151391 | 6/1999 |
| JP | A 2006-223434 | 8/2006 |
| JP | A 2007-105138 | 4/2007 |

* cited by examiner

*Primary Examiner*—Ismael Izaguirre
(74) *Attorney, Agent, or Firm*—Oliff & Berridge, PLC

(57) ABSTRACT

An embroidery frame holding workpiece cloth for embroidery sewing includes a lower frame receiving a lower side of the workpiece cloth and having a cloth clamping side, an upper frame holding the workpiece cloth in cooperation with the lower frame between the frames and having a cloth holding side, a clamp mechanism pressing the upper frame against the lower frame and retaining the upper frame in a pressing state, and a hold assisting member enhancing hold of the workpiece cloth and detachably attached to the cloth holding side of at least one of the upper and lower frames.

26 Claims, 12 Drawing Sheets

EMBROIDERY FRAME FOR USE WITH EMBROIDERY SEWING MACHINE

CROSS-REFERENCE TO RELATED APPLICATIONS

This application is based upon and claims the benefit of priority from the prior Japanese Patent Application No. 2006-154440 filed on Jun. 2, 2006, the entire contents of which are incorporated herein by reference.

BACKGROUND

1. Technical Field

The present disclosure relates to embroidery frames for use with embroidery sewing machines, and more particularly to such an embroidery frame including upper and lower frames between which workpiece cloth is held and a clamp mechanism pressing the upper frame against the lower frame and retaining the upper frame in the pressing state.

2. Description of the Related Art

In conventional sewing machines capable of performing embroidery sewing, workpiece cloth to be embroidered is held in a tightly stretched state by an embroidery frame detachably attached thereto. Conventional embroidery frames include a type in which outer and inner frames are connected together and disconnected from each other by tightening or loosening an adjusting screw. On the other hand, a clamp type cloth holding frame has recently been proposed as disclosed by JP-H08-238391A published in 1996. The clamp type cloth holding frame comprises lower and upper frames holding workpiece cloth therebetween and clamp mechanisms which press the upper frame against the lower frame thereby to hold the workpiece cloth between the frames.

The aforesaid clamp type cloth holding frame comprises a base frame (lower frame), a pressing frame (upper frame) holding workpiece cloth in cooperation with the base frame therebetween, a pair of clamp mechanisms pressing the pressing frame against the base frame thereby to separably fix the pressing frame to the base frame, a connecting mechanism which connects the pressing frame to the base frame so that the pressing frame is swingable up and down, and a pair of air cylinders driving the pressing frame via the connecting mechanism. In this embroidery frame, the air cylinders are actuated so that an input section of the clamp mechanism is lowered. As a result, the pressing frame assumes a pressing position where the pressing frame is pressed against the base frame, and the clamp mechanism assumes a clamping state thereby to reliably hold the workpiece cloth.

In the above-described clamp type cloth holding frame, however, the air cylinders are provided as a drive source for swinging the pressing frame up and down. Thus, the provision of the air cylinders results in a complicated construction, increased size and increased production cost of the clamp mechanism.

In view of the aforesaid problems, a spring member has been proposed to be used in the above-described clamp mechanism to press the upper frame against the lower frame by a spring force thereof, instead of the air cylinders. This construction can simplify the structure of the clamp mechanism and accordingly can decrease the production cost.

However, in the case where the spring force is used to press the upper frame against the lower frame, an amount of flexure is increased when workpiece cloth has a large thickness, whereupon a sufficient spring force can be obtained. On the other hand, the spring force is small when workpiece cloth has a small thickness, whereupon a sufficient holding force cannot be obtained. In particular, when workpiece cloth is made from a slippery material, there is a possibility that the workpiece cloth may be displaced within the embroidery frame and accordingly, cannot be embroidered desirably.

SUMMARY

Therefore, an object of the disclosure is to provide an embroidery frame which is a clamp type that holds workpiece cloth between upper and lower frames and which can reliably hold workpiece cloths having various thicknesses and made from various materials while having a relatively simpler structure of each clamp mechanism.

The present disclosure provides an embroidery frame holding workpiece cloth for embroidery sewing, the workpiece cloth having a lower side, the embroidery frame comprising a lower frame receiving the lower side of the workpiece cloth and having a cloth holding side, an upper frame holding the workpiece cloth in cooperation with the lower frame therebetween and having a cloth holding side, a clamp mechanism pressing the upper frame against the lower frame and retaining the upper frame in a pressing state, and a hold assisting member provided for enhancing hold of the workpiece cloth and detachably attached to the cloth holding side of at least one of the upper and lower frames.

In the above-described embroidery frame, the hold assisting member is attached to the cloth clamping side of either upper or lower frame. In this state, the workpiece cloth to be used for embroidery sewing can be held between the upper and lower frames. In this case, the hold of the workpiece cloth can be improved by the hold assisting member, whereupon the workpiece cloth can reliably be held. Moreover, no drive source such as an air cylinder is necessitated. Only provision of the hold assisting member can simplify the construction of the embroidery frame.

In one embodiment, the hold assisting member includes an engaging portion for the positioning thereof, and the lower frame has an engagement hole with which the engaging portion is engaged thereby to be held in position. When the hold assisting member is attached to the lower frame, the engaging portion thereof is caused to engage the engagement hole of the lower frame. Thus, the hold assisting member can reliably be attached to the lower frame by an easy operation without displacement. Furthermore, when the hold assisting member is to be detached from the lower frame, too, the engaging portion thereof is pulled out of the engagement hole of the lower frame. As a result, the hold assisting member can easily be detached from the lower frame.

In another embodiment, the hold assisting member is selected from plural hold assisting members which are formed into a thin plate shape and have different plate thicknesses. For example, when workpiece cloth to be held has a large thickness, a hold assisting member with a small thickness is selected. On the other hand, when workpiece cloth to be held has a small thickness, a hold assisting member with a large thickness is selected. Thus, the hold assisting member with a suitable thickness is selected according to the thickness of workpiece cloth. Consequently, a stable clamping force can be obtained with respect to workpiece cloths with various thicknesses.

In further another embodiment, the hold assisting member includes a thin base plate having elasticity and a holding member having a function of preventing the workpiece cloth from sliding. When the slip-proof holding member is disposed on the surface of the hold assisting member, the clamped workpiece cloth becomes hard to slide and accordingly, a holding performance can be improved. More specifically, the holding member may comprise a thin sheet-like pile including a piece of foundation cloth on which plural pieces of short fiber are transplanted. In the case where the thin sheet-like pile is employed as the holding member, the embroidery frame preferably has a predetermined embroidery-sewable region, and the short fiber is preferably formed so as to be inclined upward and so as to be directed outward from the embroidery-sewable region. Consequently, the held workpiece cloth becomes hard to displace inside the embroidery-sewable region (inner region of the embroidery frame) and accordingly more effective.

Alternatively, the holding member may comprise an abrasive grain sheet including a sheet-like base material with a surface on which fine abrasive grain is secured. Furthermore, the holding member may comprise sheet-like urethane foam.

When plural hold assisting members having different types of holding members as described above, a holding member with a high slide-proof function is selected according to a material of the workpiece cloth and attached. Consequently, the embroidery frame is rendered further effective. For example, the hold assisting member having the pile as the holding member is suitable for a case where workpiece cloth such as combed cotton or nonwoven cloth (felt) is to be held. In the case of small workpiece cloth the entire of which constitutes an embroidery pattern part such as patch, the hold assisting member having the abrasive grain sheet as the holding member is suitable for a case of small workpiece cloth the entire of which constitutes an embroidery pattern part such as patch. In the case of workpiece cloth with smooth surface such as vinyl cloth, the hold assisting member having the urethane foam as the holding member is suitable of a case of workpiece cloth with smooth surface such as vinyl cloth.

The disclosure also provides an embroidery frame holding workpiece cloth for embroidery sewing, the workpiece cloth having a lower side, the embroidery frame comprising a lower frame receiving the lower side of the workpiece cloth and having a cloth clamping side, an upper frame holding the workpiece cloth in cooperation with the lower frame therebetween and having on a cloth holding side a holding member having a function of preventing the workpiece cloth from sliding, and a clamp mechanism pressing the upper frame against the lower frame and retaining the upper frame in a pressing state, the clamp mechanism having an upper frame attaching/detaching mechanism to which the upper frame is detachably attached.

In the above-described embroidery frame, the workpiece cloth can be held between the upper and lower frames with the slide-proof holding member being provided on the cloth holding surface of the upper frame. In this case, the holding member can improve the hold of the workpiece cloth such that the workpiece cloth can reliably be held. Moreover, no drive source such as an air cylinder is necessitated. Only provision of the hold assisting member can simplify the construction of the embroidery frame. Additionally, since the upper frame is detachably attached to the clamp mechanism, the upper frame can be replaced by another according to the thickness or material of the workpiece cloth.

The upper frame may be selected from the plural upper frames having the holding members made from different materials respectively, and the selected upper frame may be attached to the upper frame attaching/detaching mechanism. Consequently, when the upper frame having a holding member of a suitable material is selected to be attached, a stable holding force can be obtained regarding workpiece cloths of various materials.

BRIEF DESCRIPTION OF THE DRAWINGS

Other objects, features and advantages of the present disclosure will become clear upon reviewing the following description of the illustrative examples with reference to the accompanying drawings, in which.

DETAILED DESCRIPTION OF THE DISCLOSURE

Figure 1:
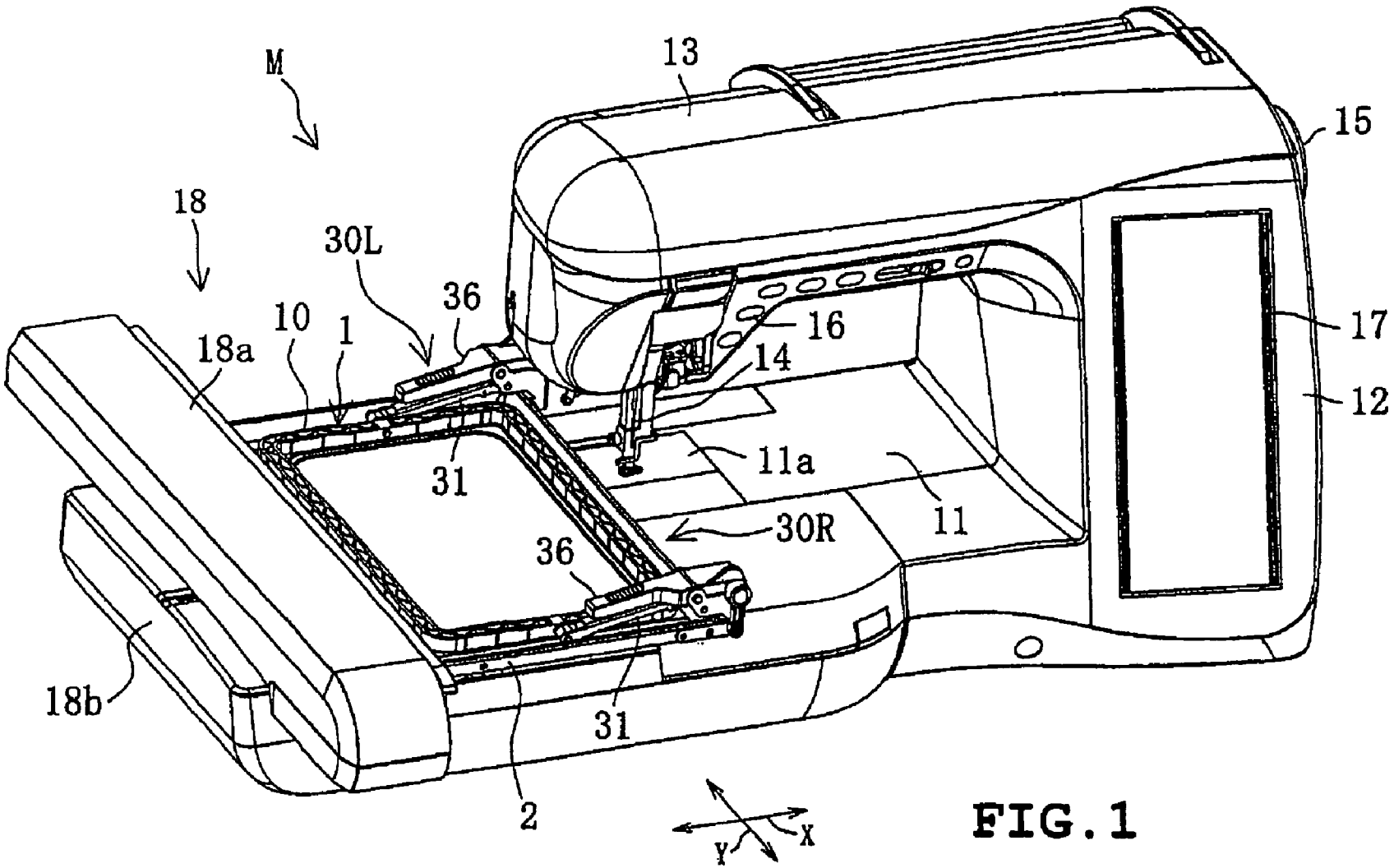
FIG. 1 is a perspective view of a sewing machine in accordance with a first illustrative example of the disclosure, the sewing machine being attached with an embroidery frame.

A first illustrative example of the disclosure will be described with reference to FIGS. 1 to 7. The disclosure is applied to an embroidery frame for use with an electronic sewing machine. Referring to FIG. 1, an overall electronic sewing machine M which is capable of performing embroidery sewing is shown. The electronic sewing machine M includes a sewing bed 11 extending in the right-and-left direction (the X direction), a sewing pillar 12 rising upward from a right end of the bed 11 and a sewing arm 13 extending leftward from an upper end of the pillar 12, all of which are formed integrally.

The arm 13 has a distal end including a lower part on which a needle bar with a sewing needle 14 is mounted. The bed 11 has a top on which a needle plate 11*a* is mounted so as to correspond to the sewing needle 14. The bed 11 encloses therein a full rotary hook which forms stitches in cooperation with the sewing needle 14, a feed dog forward/backward moving mechanism and a thread cutting mechanism, none of which are shown. The arm 13 includes a hand-driven pulley 15 which is mounted on a right-hand side for manually rotating a sewing machine main shaft (not shown) The arm 13 also includes a front on which are provided various switches such as a start/stop switch 16 instructing start or stop of a sewing operation. Furthermore, the pillar 12 includes a front on which is mounted a liquid-crystal display 17 which displays stitch patterns such as ordinary patterns, embroidery patterns and the like and various messages.

A known embroidery machine 18 is adapted to be detachably attached to a left end of the bed 11. The embroidery machine 18 freely moves a clamp type embroidery frame 1 of the illustrative example in the X and Y directions over the bed 11 as will be described in detail later. In the illustrative example, the direction in which the bed 11 extends is referred to as "X direction" and the direction perpendicular to the X direction is referred to as "Y direction" as shown in FIG. 1.

The embroidery machine 18 comprises a body 18*b* which is on a level with the top (bed face) of the bed 11 when attached to the sewing machine M. The embroidery machine 18 further comprises a drive section 18*b* which is mounted on the top of the body 18*a* so as to be movable in the X direction. A carriage (not shown) is mounted on a side of the drive section 18*b* so as to be movable in the Y direction. The embroidery frame 1 includes a connecting frame 9 (see FIG. 2) which is detachably connected to the carriage. The body 18*b* encloses therein an X direction driving mechanism provided for driving the drive section 18*b* and comprising an X feed motor. The drive section 18*a* encloses therein a Y direction driving mechanism provided for driving the carriage in the Y direction and comprising a Y feed motor. The embroidery machine 18 is controlled by a control device (control unit) of the electronic sewing machine M so that the embroidery frame 1 is moved in the X and Y directions, whereby an embroidery sewing operation is automatically carried out for workpiece cloth held by the embroidery frame 1.

The clamp type embroidery frame 1 of the illustrative example will now be described in detail with reference to FIGS. 2 to 7. The side of the embroidery frame 1 provided with a connecting frame 9 which is to be connected to the embroidery machine 18 will be referred to as a front of the frame 1 for the sake of description although the front of the sewing machine M does not correspond to the front of the frame 1. The embroidery frame 1 comprises a lower frame 2, an upper frame 10 holding the workpiece cloth in cooperation with the lower frame 2 therebetween and a pair of right and left clamp mechanisms 30R and 30L pressing the upper frame 10 against the lower frame 2 and retaining the upper frame 10 in the pressed state. The clamp mechanisms 30R and 30 L are mounted so as to be located at rear portions of the right and left sides of the embroidery frame 1 respectively. In this case, inside the embroidery frame 1 is defined a rectangular embroidery sewing region which is oblong in the right-and-left direction. The clamp mechanisms 30R and 30L are disposed at two opposite locations so that the embroidery sewing region is located therebetween, respectively. The clamp mechanisms 30R and 30L are bilaterally symmetric with each other.

Figure 2:
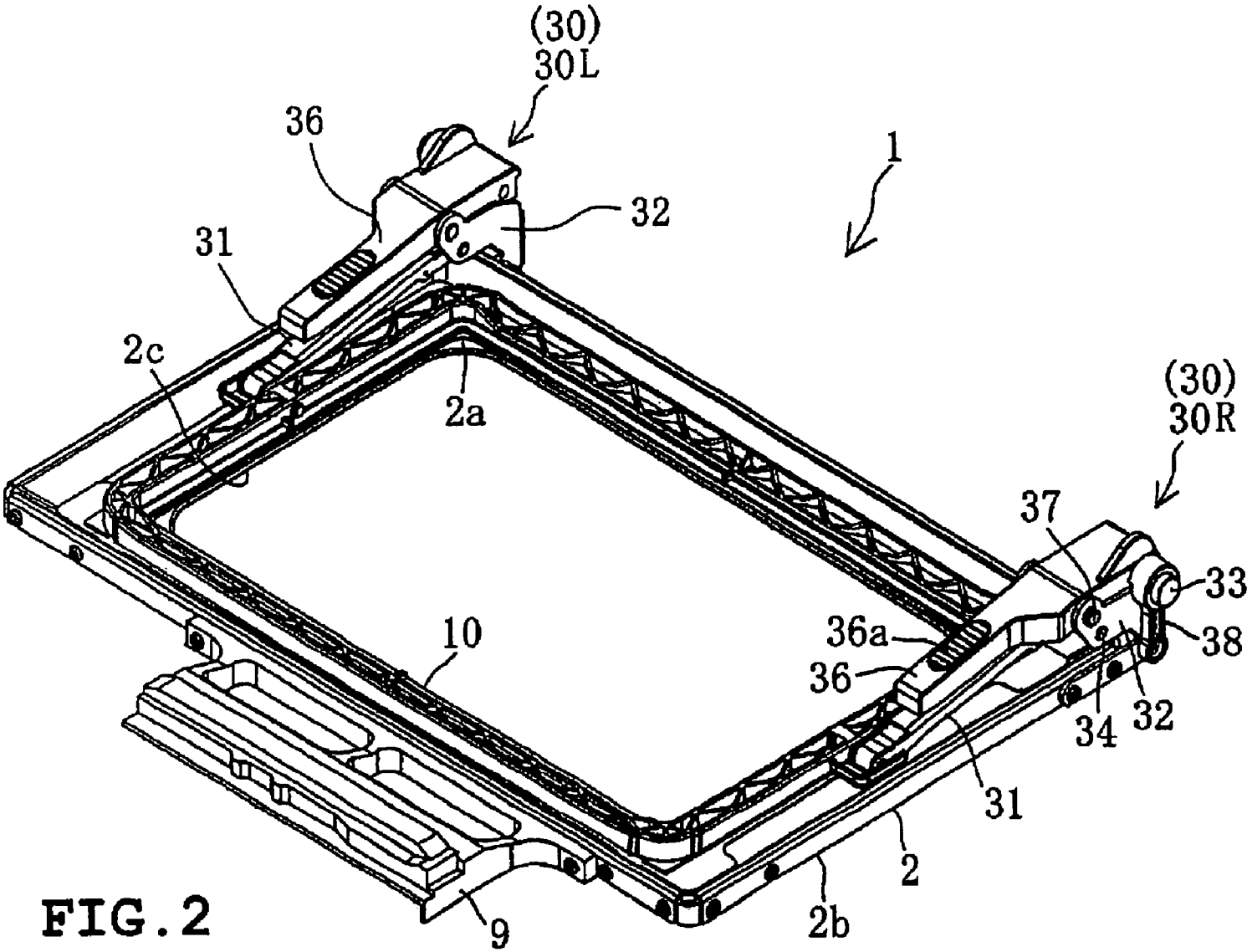
FIG. 2 is a perspective view of the embroidery frame.
Figure 3:
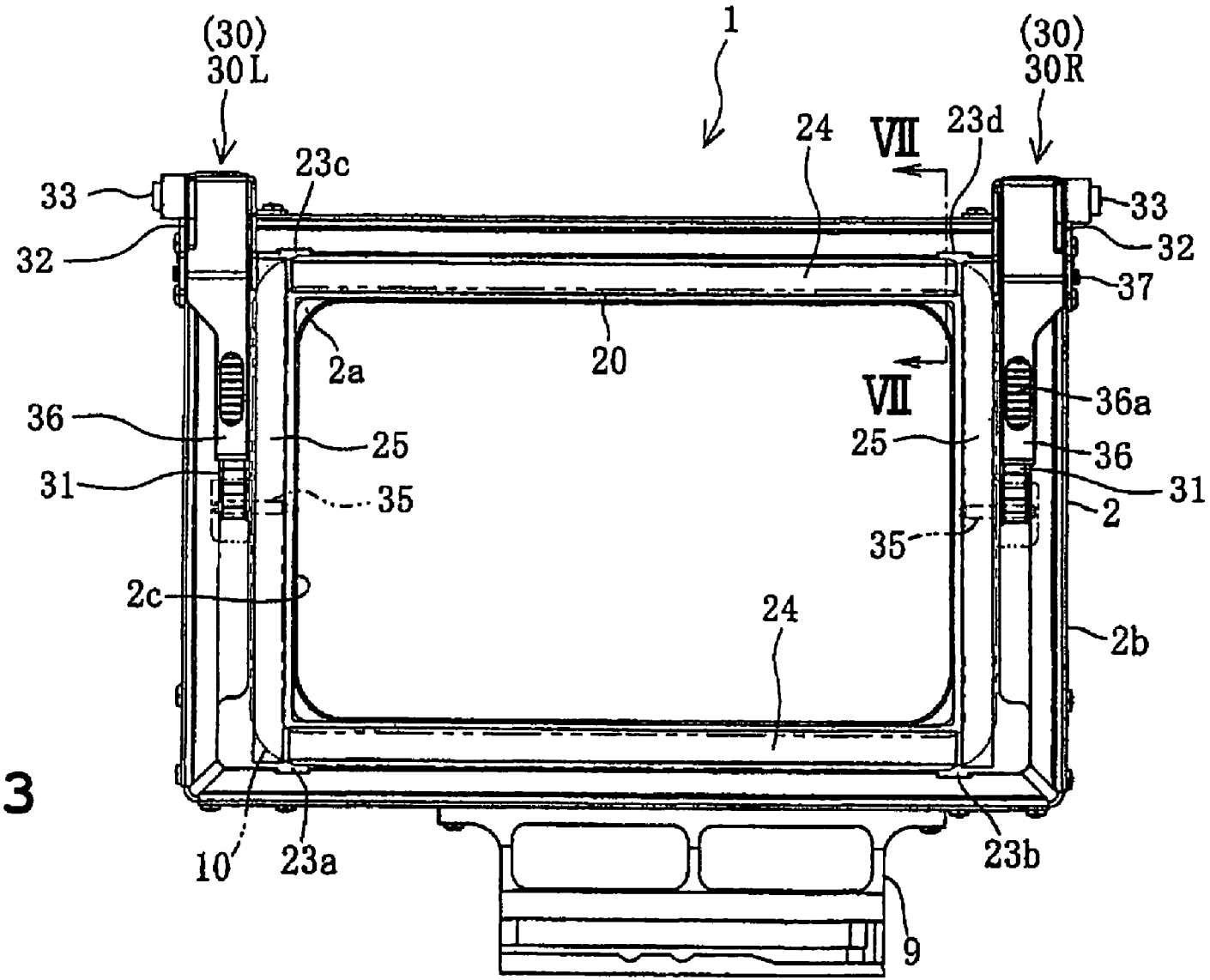
FIG. 3 is a plan view of the embroidery frame to which an assisting member is attached, while the upper frame is detached.
Figure 4:
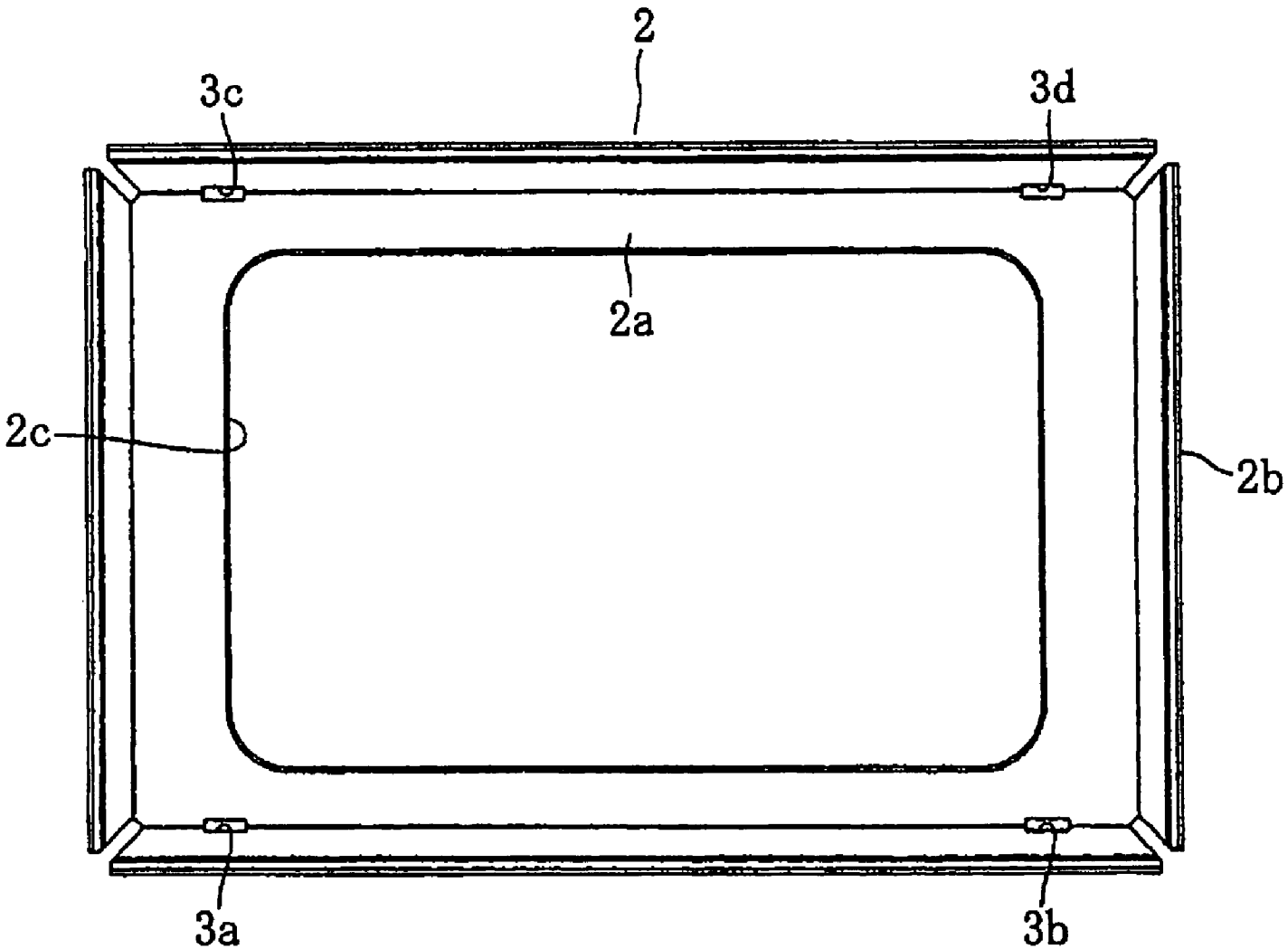
FIG. 4 is a plan view of the lower frame.

The lower frame 2 is made of a metal plate and includes a rectangular frame-shaped holding plate 2*a* holding the lower side of the workpiece cloth and a wall 2*b* rising from an outer periphery of the holding plate 2*a* as shown in FIGS. 2 to 4. The lower frame 2 is formed integrally with the holding plate 2*a* and the wall 2*b*. The holding plate 2*a* has a centrally defined large rectangular opening 2*c* formed for embroidery sewing. Furthermore, thin expandable rubber tapes 4 and 5 are affixed to a rectangular frame-shaped part so as to be opposed to the upper frame 10 of the holding plate 2*a*. Each of the expandable rubber tapes 4 and 5 serves as a slide-resistance in the case where the workpiece cloth is directly held.

Each of front and rear sides of the lower frame 2 has right and left ends formed with engagement holes 3*a* to 3*d* as shown in FIG. 4. A hold assisting member 20 has engaging portions which are adapted to be engaged with the engagement holes 3*a* to 3*d* respectively as shown in FIG. 3. The hold assisting member 20 will be described in detail later. The engagement holes 3*a* to 3*d* are each formed into the shape of a slit elongated in the right-and-left direction and located at the boundary between the holding plate 2*a* and the rising wall 2*b*. A connecting frame 9 made from a synthetic resin is screwed to the front end of the lower frame 2 so as to be connected to the embroidery machine 18. Two supporting members 32 are secured to rear ends of the right and left sides of the lower frame 2 in order to support clamp mechanisms 30R and 30L respectively. Each supporting member 32 is formed by bending a metal plate into a generally C-shape as viewed from an upper face thereof.

On the other hand, as shown in FIG. 2, the upper frame 10 is made from a synthetic resin and formed into the shape of a generally rectangular frame which extends along the holding plate 2*a* and is accordingly smaller than the rising wall 2*b*. The upper frame 10 is rotatably connected to connecting members 31 of the clamp mechanisms 30 R and 30L, whereupon the upper frame 10 can be mounted so as to be vertically swingable between a holding position (see FIGS. 1 and 2) where the upper frame 10 presses the workpiece cloth against the lower frame 2 and an opening position (not shown) which is spaced upward from the lower frame 2.

Figure 6:
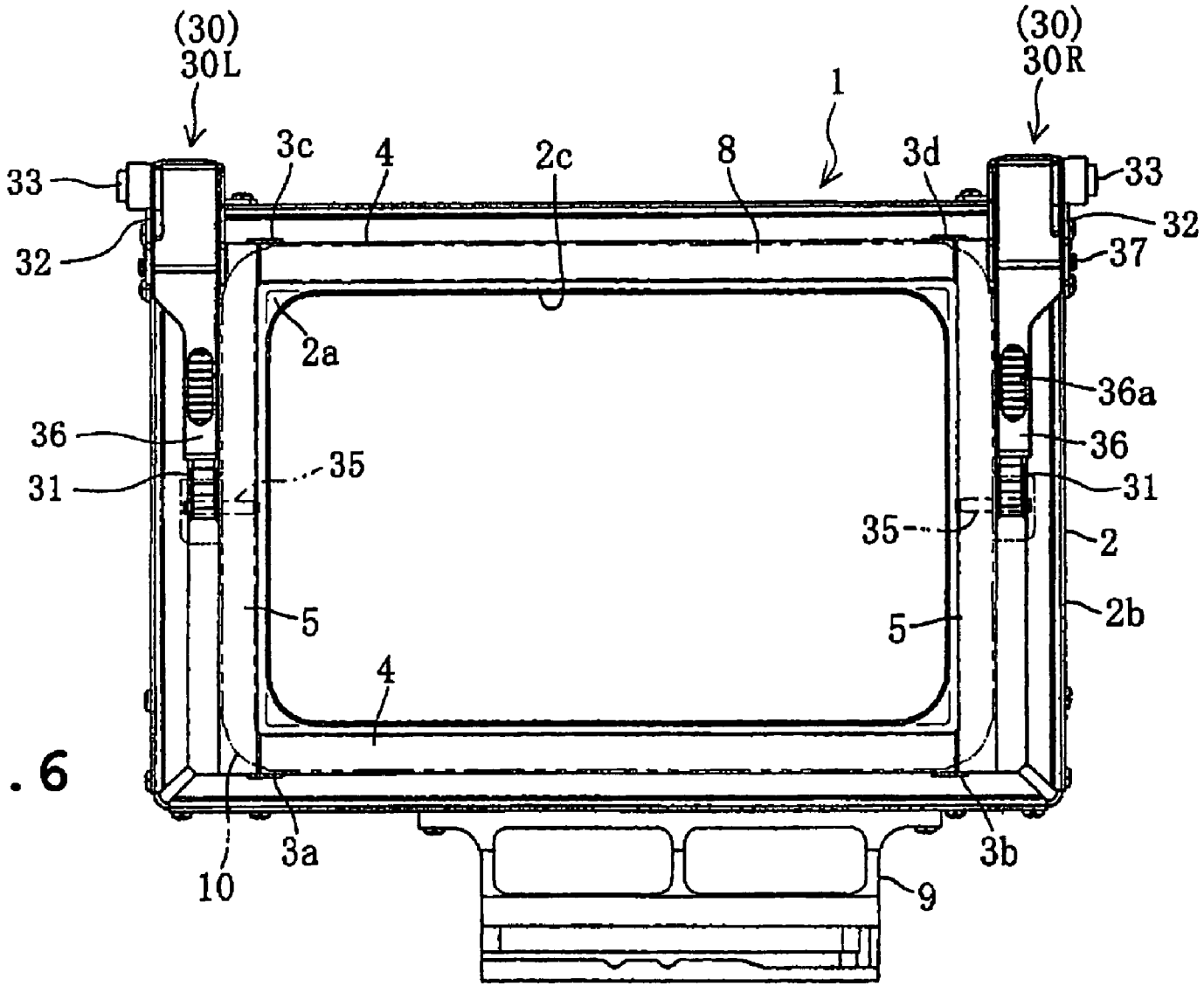
FIG. 6 is a plan view of the embroidery frame with the assisting member and the upper frame being detached.

The clamp mechanisms 30R and 30L will now be described in detail with reference to FIGS. 2, 3 and 6. Only the right-hand clamp mechanism 30R will be described since the two clamp mechanisms are bilaterally symmetrical. The clamp mechanism 30R comprises a connecting member 31 extending along the right side of the upper frame 10 in the front-and-rear direction, a locking mechanism (not shown) locking the upper frame at the holding position where the upper frame 10 presses the workpiece cloth against the lower frame 2, and an unlocking button 33 for unlocking the upper frame 10. The connecting member 31 has a rear end which is supported by a first support pin 34 mounted on the supporting member 32 so as to be pivotable (swingable vertically). The connecting member 31 further has a front end which is connected by a second support pin 35 to a middle portion of the upper frame 10 in the front-and-rear direction so as to be pivotable. As a result, the upper frame 10 is vertically moved with vertical swing of the connecting member 31 about the first support pin 34.

The locking mechanism includes an operation lever 36 located over the connecting member 31. The operation lever 36 is made from a synthetic resin and extends in the front-and-rear direction. The operation lever 36 has a front end including an upper face formed with an operating part 36*a* which has an underside having a protrusion (not shown) protruding downward and formed integrally therewith. The operation lever 36 includes a middle portion (a portion nearer to the rear) in the front-and-rear direction. The middle portion of the operation lever 36 is pivotally supported by a third support pin 37 mounted on the supporting member 32. The third support pin 37 is located higher than the first support pin 34. Furthermore, the connecting member 31 is elastically urged by an urging spring comprising a coil spring in a clockwise direction in FIG. 2 or in such a direction that the upper frame 10 is opened. Consequently, the connecting member 31, the operation lever 36 and the upper frame 10 are usually urged to the opening position side. An urging spring (not shown) comprising an elongated leaf spring is enclosed in the connecting member 31. The urging spring has a front end wound into and connected to the second support pin 35. The urging spring further has a rear end fitted in a space defined between the first and third support pins 34 and 37. As the result of the above-described construction, when the operation portion 36*a* of the operation lever 36 is manually caused to pivot downward by the operator, the middle portion of the press urging pin is pressed downward by the protrusion thereby to be elastically deformed. The resultant elastic force moves the upper frame 10 to the holding position where the workpiece cloth is pressed, whereupon the upper frame 10 is pressed by the lower frame 2. In this case, the rear end of the operation lever 36 is locked by the locking mechanism in the following manner so that the upper frame 10 is maintained in the pressed state.

The locking mechanism of the clamp mechanism 30R will be described. A pin member (not shown) is attached near the right end of the operation lever 36 and urged to the right by a compression spring (not shown). When the operation portion 36*a* of the operation lever 36 is pressed downward thereby to be caused to pivot, the pin member engages the engagement hole (not shown) formed in the supporting member 32, whereby the operation lever 36 is locked so as to be disallowed to pivot. The unlocking button 33 for unlocking the operation lever 36 is held in the upper end in a fitted state and urged by the compression spring so as to protrude rightward.

When the unlocking button 33 is pushed, the pin member disengages from the engagement hole such that the operation lever 36 is unlocked. As a result, the connecting member 31 and the operation lever 36 are moved upward by the spring force of the urging spring, whereupon the upper frame 10 is displaced from the holding position where the workpiece cloth is pressed to the opening position. The left clamp mechanism 30L disposed in the lateral symmetry with the right clamp mechanism 30R is also constructed as described above and accordingly the description of the left clamp mechanism 30L will be eliminated.

Figure 5:
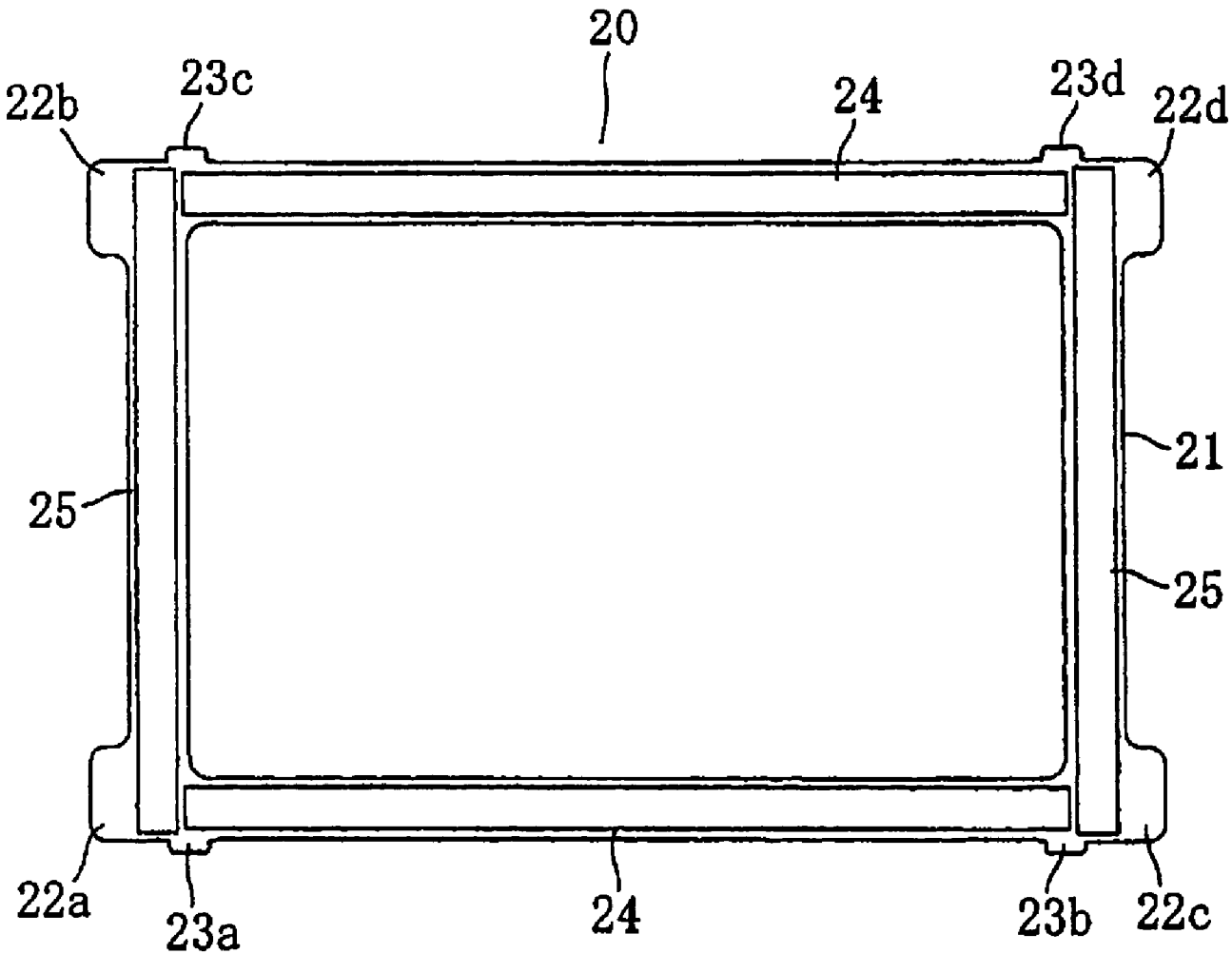
FIG. 5 is a plan view of the assisting member.

A hold assisting member 20 (see FIG. 6) is detachably attached to a cloth holding face 8 (see FIG. 6) or an upper face of the holding plate 2*a* of the lower frame 2 in the illustrative example. The hold assisting member 20 increases the holding property with respect to the workpiece cloth. The hold assisting member 20 will be described with reference to FIGS. 5 to 7. The hold assisting member 20 is formed into the shape of a generally rectangular thin plate having a size corresponding to the holding plate 2*a* of the lower frame 2 as shown in FIG. 5. In the illustrative example, the hold assisting member 20 comprises a base plate 21 having predetermined elasticity (elastically deformable) or a thin metal plate (steel plate) and two holding members 24 and two holding members 25 both affixed to an upper face of the base plate 21. Each of the holding members 24 and 25 has a high friction coefficient and a function of preventing the workpiece cloth from sliding. Each holding member 24 is formed into the shape of a narrow strip. The holding members 24 are affixed to front and rear sides of the base plate 21 respectively. Each holding member 25 is also formed into the shape of a narrow strip of the same material as the holding member 24 but is slightly shorter in the length than the holding member 24. The holding members 25 are affixed to the left and right sides of the base plate 21 respectively.

Two engaging protrusions 23*a* and 23*b* are formed on the left and right ends of the front side of the base plate 21 or portions of the base plate 21 corresponding to the engagement holes 3*a* and 3*b* of the front side of the lower frame 2 respectively. The engaging protrusions 23*a* and 23*b* are provided for positioning the hold assisting member 20 in the case where the hold assisting member 20 is attached to the lower frame 2. The engaging protrusions 23*a* and 23*b* are formed integrally with the base plate 21 so as to protrude frontward. Furthermore, two engaging protrusions 23*c* and 23*d* are formed on the left and right ends of the rear side of the base plate 21 or portions of the base plate 21 corresponding to the engagement holes 3*c* and 3*d* of the rear side of the lower frame 2 respectively. The engaging protrusions 23*c* and 23*d* are provided for positioning the hold assisting member 20 in the case where the hold assisting member 20 is attached to the lower frame 2. The engaging protrusions 23*c* and 23*d* are formed integrally with the base plate 21 so as to protrude rearward.

Thus, when the hold assisting member 20 is attached to the lower frame 2, the engaging protrusions 23*a* to 23*d* are inserted into and engaged with the respective engagement holes 3*a* to 3*d*, whereby the hold assisting member 20 can be held on the lower frame 2. The engagement is carried out while the base plate 21 is elastically flexed. Furthermore, when the hold assisting member 20 is detached from the lower frame 2, the engaging protrusions 23*a* to 23*d* are pulled out of the respective engagement holes 3*a* to 3*d* while the base plate 21 is elastically flexed.

The base plate 21 has two protrusions 22*a* and 22*b* which are formed integrally on the front and rear ends of the left side thereof so as to protrude leftward, respectively. The base plate 21 further has two protrusions 22*c* and 22*d* which are formed integrally on the front and rear ends of the right side thereof so as to protrude rightward, respectively. These protrusions 22*a* to 22*d* have respective distal ends which are adapted to abut against an inner face of the rising wall 2*b* of the lower frame 2 when the hold assisting member 20 has been attached to the lower frame 2. As a result, the hold assisting member 20 is positioned in the right-and-left direction.

In the illustrative example, plural base plates 21 having different thicknesses are prepared. In the example are also provided plural holding members 24 and 25 each having different thicknesses and made from different materials. One of the base plates 21 is selectively attached to the lower frame 2. One of the holding members 24 and one of the holding members 25 are selectively attached to the lower frame. More specifically, seven types of base plates 21 are prepared and have thicknesses of, for example, 0.3 mm, 0.5 mm, 0.8 mm, 1.0 mm, 1.2 mm, 1.6 mm and 1.8 mm respectively. Three types of holding members 24 and three types of holding members 25 are prepared for each base plate 21 as will be described later. Accordingly, twenty-one types of hold assisting members 20 are prepared in total. All the holding members 24 and 25 have respective thicknesses which are all set to about 1.0 mm, for example.

Figure 7:
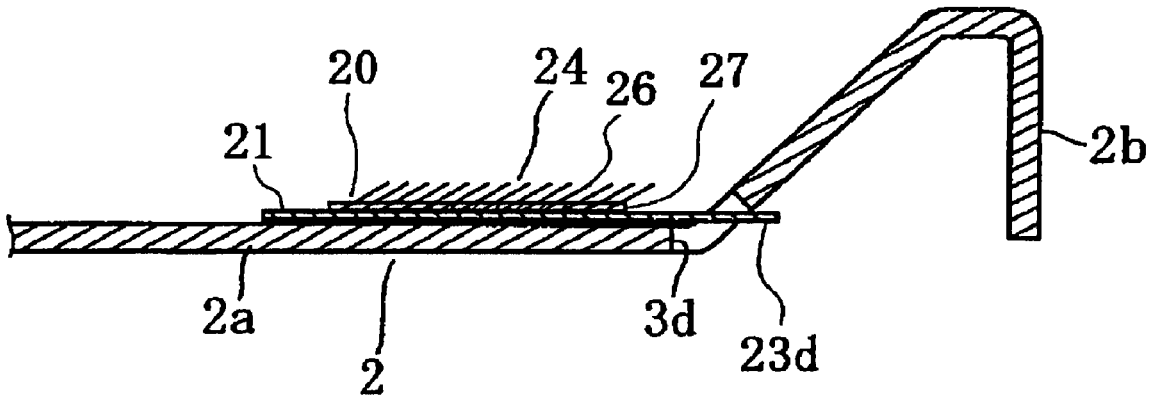
FIG. 7 is a longitudinally sectional view of the lower frame taken along line VII-VII in FIG. 3.

Each of first holding members 24 and 25 comprises a thin sheet-like pile including a piece of foundation cloth 27 on which plural pieces of short fiber 26 are transplanted, as shown in FIG. 7 exemplifying the holding member 24. In this case, the short fiber 26 is transplanted so as to be inclined upward and so as to be directed outward from an embroidery-sewable region of the embroidery frame 1. Each of second holding members 24 and 25 comprises an abrasive grain sheet (not shown) including a sheet-like base material with a surface on which fine abrasive grain (emery, glass or the like) is secured. Each of third holding members 24 and 25 comprises sheet-like urethane foam (sheet-shaped resin foam or foamed rubber) although the urethane foam is not shown.

In this case, one of the seven types of hold assisting members 20 is selected. The selected hold assisting member 20 has a thickness (the plate thickness of the base plate 21) according to the thickness of the workpiece cloth to be held. More specifically, when the workpiece cloth to be held has a large thickness, a hold assisting member 20 having a smaller thickness is selected. On the other hand, when the workpiece cloth to be held has a small thickness, a hold assisting member 20 having a larger thickness is selected. Additionally, when the workpiece cloth to be held has a greatly large thickness, the embroidery sewing can be carried out without attachment of the hold assisting member 20.

Each of the holding members 24 and 25 is selected depending upon the material of the workpiece cloth to be held. For example, the hold assisting member 20 having the pile as each of the holding members 24 and 25 is suitable for the case where workpiece cloth such as combed cotton or nonwoven cloth is to be held. The hold assisting member 20 having the abrasive grain sheet as each of the holding members 24 and 25 is suitable for the case of small workpiece cloth the entire of which constitutes an embroidery pattern part such as patch. The hold assisting member 20 having the urethane foam as each of the holding members 24 and 25 is selected in the case where workpiece cloth with smooth surface such as vinyl cloth is to be held.

The following will describe the operation and effect of the clamp type embroidery frame 1 with the above-described construction. When workpiece cloth to be embroidered is held by the embroidery frame 1, the hold assisting member 20 is attached to the cloth holding surface 8 of the upper side of the lower frame 2 while the upper frame 10 assumes the open position. Since plural types of hold assisting members 20 having different thicknesses and holding members 24 and 25 are prepared, the user selects one of the hold assisting members 20 according to the thickness and material of the workpiece cloth to be held. In attachment of the hold assisting member 20, the engaging protrusions 23*a* to 23*d* are inserted into and engaged with the respective engagement holes 3*a* to 3*d* in the state as shown in FIG. 6 while the base plate 21 is elastically flexed, whereby the engaging protrusions 23*a* to 23*d* are held in the respective engagement holes 3*a* to 3*d*. Thus, the hold assisting member 20 can reliably be attached to the embroidery frame 1 by a simple operation.

After the hold assisting member 20 has been attached to the lower frame 2, the user causes the workpiece cloth to be held in a tightly stretched state on the lower frame 2, as shown in FIG. 3. In this state, the user presses the operation lever 36 downward so that the upper frame 10 is lowered thereby to be displaced to the holding position. As a result, the workpiece cloth is held between the lower and upper frames 2 and 10 and held in the tightly stretched state within the embroidery frame 1 (the embroidery sewable region). An embroidery sewing operation is carried out by the sewing machine M in this state.

In this case, the hold assisting member 20 having the predetermined thickness is also held between the lower and upper frames 2 and 10 as well as the workpiece cloth. Consequently, since the thickness of the frame 1 is increased by the thickness of the hold assisting member 20, an amount of flexure of the urging spring is increased accordingly, whereupon a sufficient spring force or a sufficient holding force can be obtained. Furthermore, since the selected hold assisting member 20 has a suitable thickness according to the thickness of workpiece cloth, a stable (substantially constant) holding force can be achieved for workpiece cloths of various thicknesses.

Furthermore, the lower surface of the workpiece cloth is pressed against the upper surfaces of the holding members 24 and 25 each of which has a slide-proof function. Accordingly, since a frictional force is increased between both surfaces, displacement (slide) of the workpiece cloth relative to the embroidery frame 1 can effectively be reduced. Moreover, the hold assisting member 20 is selected which has one of three types of each of the holding members 24 and 25 selected according to the material of the workpiece cloth. Consequently, the slide-proof effect can further be improved.

Furthermore, in each of the foregoing first holding members 24 and 25, the hold assisting member 20 is provided with the thin sheet-like pile including the foundation cloth 27 on which a plurality of pieces of short fiber 26 are transplanted. The short fiber 26 is formed so as to be inclined upward and so as to be directed outward from the embroidery-sewable region of the embroidery frame 1, as shown in FIG. 7. Consequently, the workpiece cloth can effectively be prevented from displacement inside the embroidery sewable region.

When the workpiece cloth is detached from the embroidery frame 1 after completion of the embroidery sewing operation, the user presses the unlocking button 33 to displace the upper frame 10 to the open position. Only the workpiece cloth can be taken out in this state. When another type of workpiece cloth with different thickness and material is to be used in subsequent embroidery sewing, the engaging protrusions 23*a* to 23*d* are pulled out of the respective engagement holes 3*a* to 3*d* while the base plate 21 is elastically flexed. Thus, the hold assisting member 20 can be detached from the lower frame by a simple operation, whereupon the hold assisting member 20 can easily be replaced by another.

According to the foregoing illustrative example, the clamp type embroidery frame 1 holding the workpiece cloth between the upper and lower frames 10 and 2 is provided with the hold assisting member 20 which is detachably attached to the cloth holding surface 8 of the lower frame 2. Consequently, the workpiece cloth can reliably be held and prevented from being displaced during embroidery sewing such that the embroidery pattern can be prevented from being displaced. Moreover, no drive source such as air cylinders is necessitated, but only the hold assisting member 20 needs to be provided, which provides a simple construction of the embroidery frame.

Particularly in the foregoing example, plural types of hold assisting members 20 are prepared which differ in the plate thickness and the material of the holding members 24 and 25. A suitable one of the hold assisting members 20 is selected and attached according to the thickness and the material of the workpiece cloth. Consequently, a stable holding force can be obtained with respect to various thicknesses and materials, whereupon the holding performance of the embroidery frame 1 can be improved.

Furthermore, particularly in the foregoing example, the hold assisting member 20 is provided with the positioning engaging protrusions 23*a* to 23*d*. The lower frame 2 is provided with the engagement holes 3*a* to 3*d* into which the engaging protrusions 23*a* to 23*d* are inserted to be engaged with the engagement holes, respectively. Consequently, the hold assisting member 20 can easily be attached to and detached from the lower frame 2. The hold assisting member 20 can also be attached reliably without displacement.

A second illustrative example will be described with reference to FIGS. 8 to 12. Identical or similar parts in the second illustrative example are labeled by the same reference symbols as those in the first illustrative example. The description of these identical or similar parts will be eliminated and only the difference of the second example from the first example will be described in the following.

Two holding members 52 and 53 each having a slide-proof function are mounted on the cloth holding surface of the lower surface of the upper frame 10A, instead of hold assisting member 20 mounted on the lower frame 2. The upper frame 10A is constructed to be detachably attached to the clamp mechanisms 30R and 30L. Furthermore, plural types of upper frames 10A are prepared in the second example.

Figure 11:
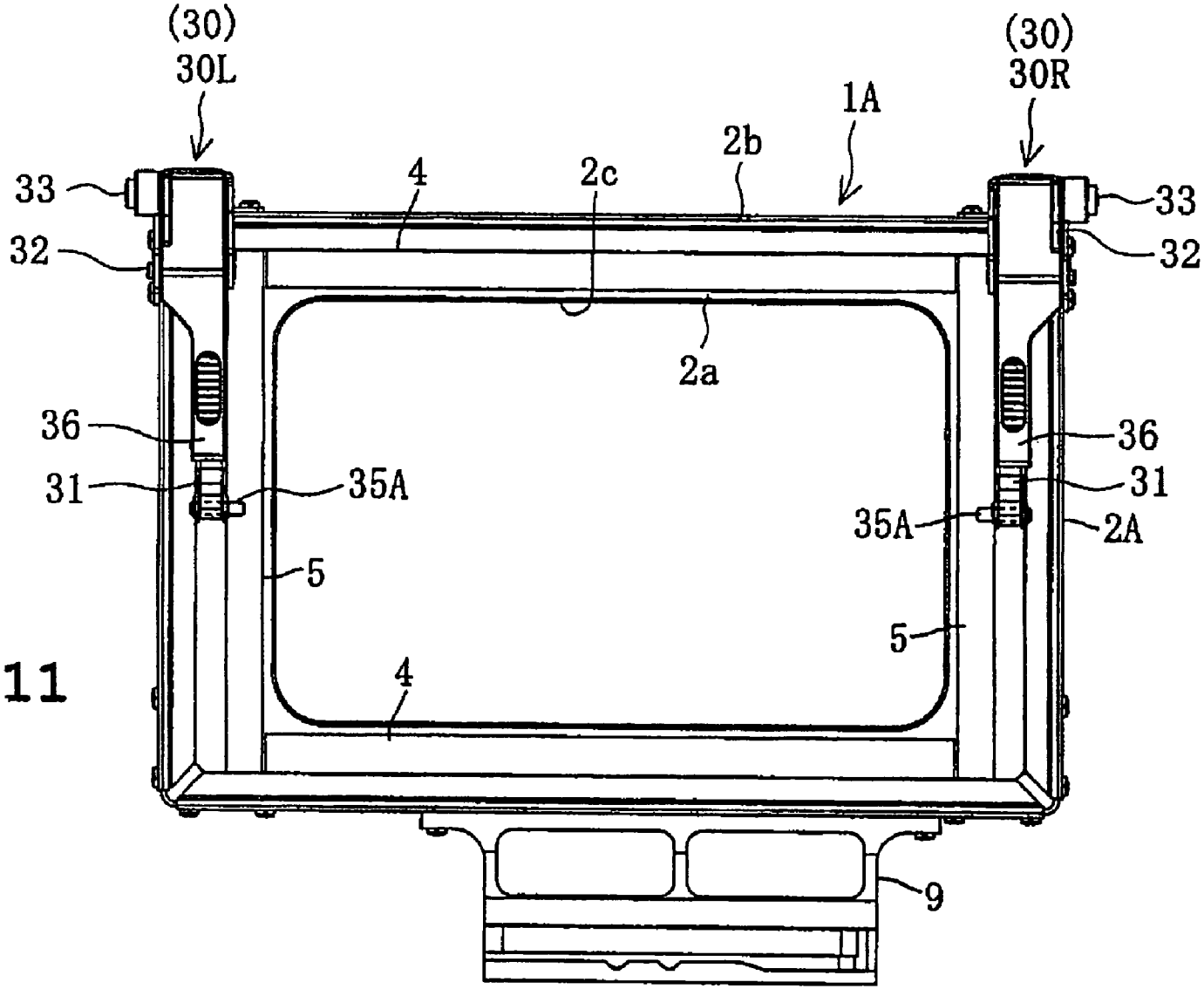
FIG. 11 is a plan view of the embroidery frame with the upper frame being detached.

The embroidery frame 1A of the second example comprises the upper frame 10A, lower frame 2A, a pair of clamp mechanisms 30R and 30L and an upper frame attaching/detaching mechanism 55. The lower frame 2A is formed with no such engagement holes as the engagement holes 3*a* to 3*d* and has substantially the same construction as the lower frame 2 in the first example in the other respects. More specifically, the lower frame 2A includes a holding plate 2*a* having a rectangular opening 2*c* and the rising wall 2*b* formed integrally on the holding plate 2*a* as shown in FIG. 11. Foamed rubber tape strips 4 and 5 are affixed on the upper surface of the support plate 2*a*. Furthermore, the connecting frame 9 is screwed to the front side of the lower frame 2A.

Figure 8:
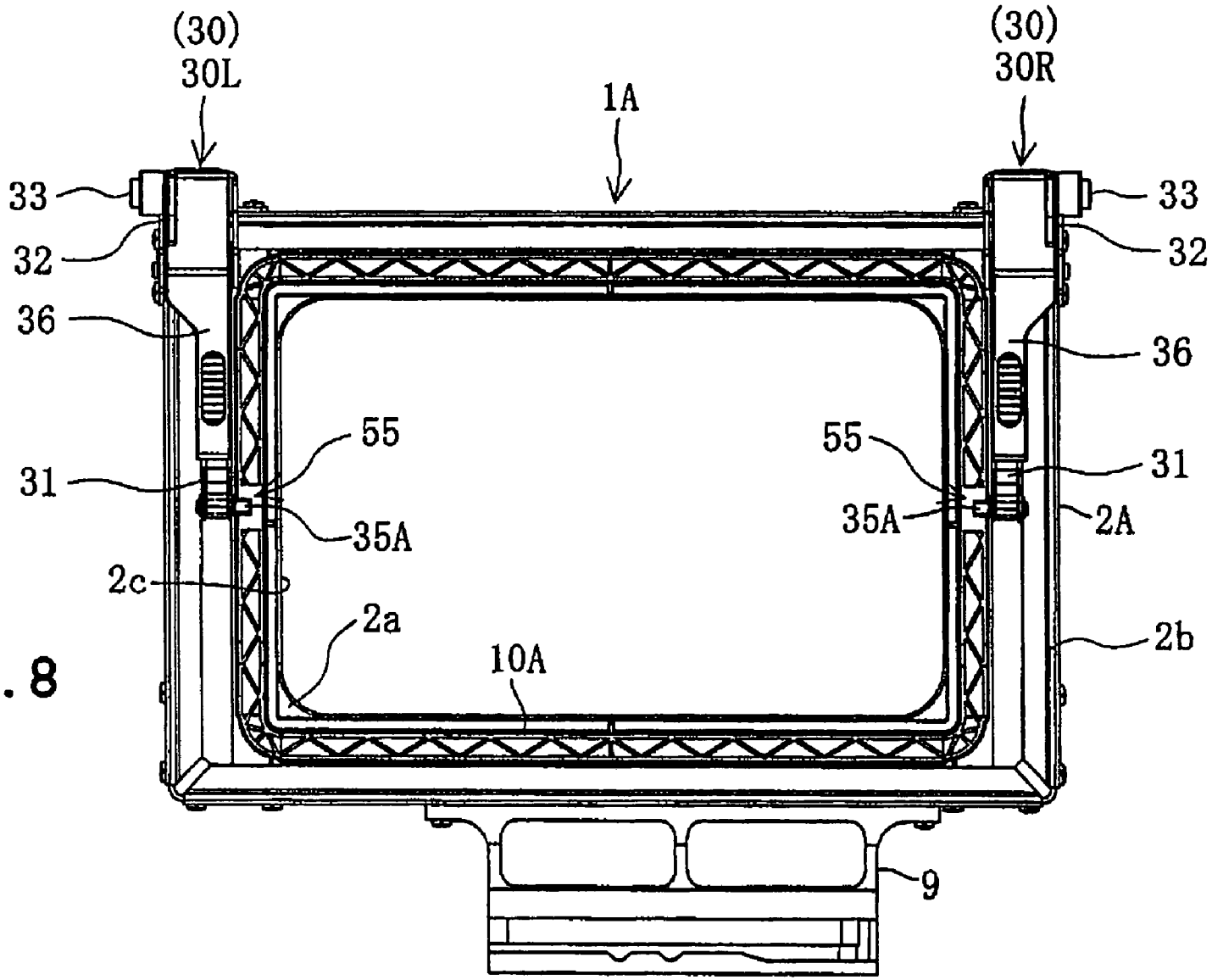
FIG. 8 is a plan view of the embroidery frame in accordance with a second illustrative example of the disclosure.
Figure 9:
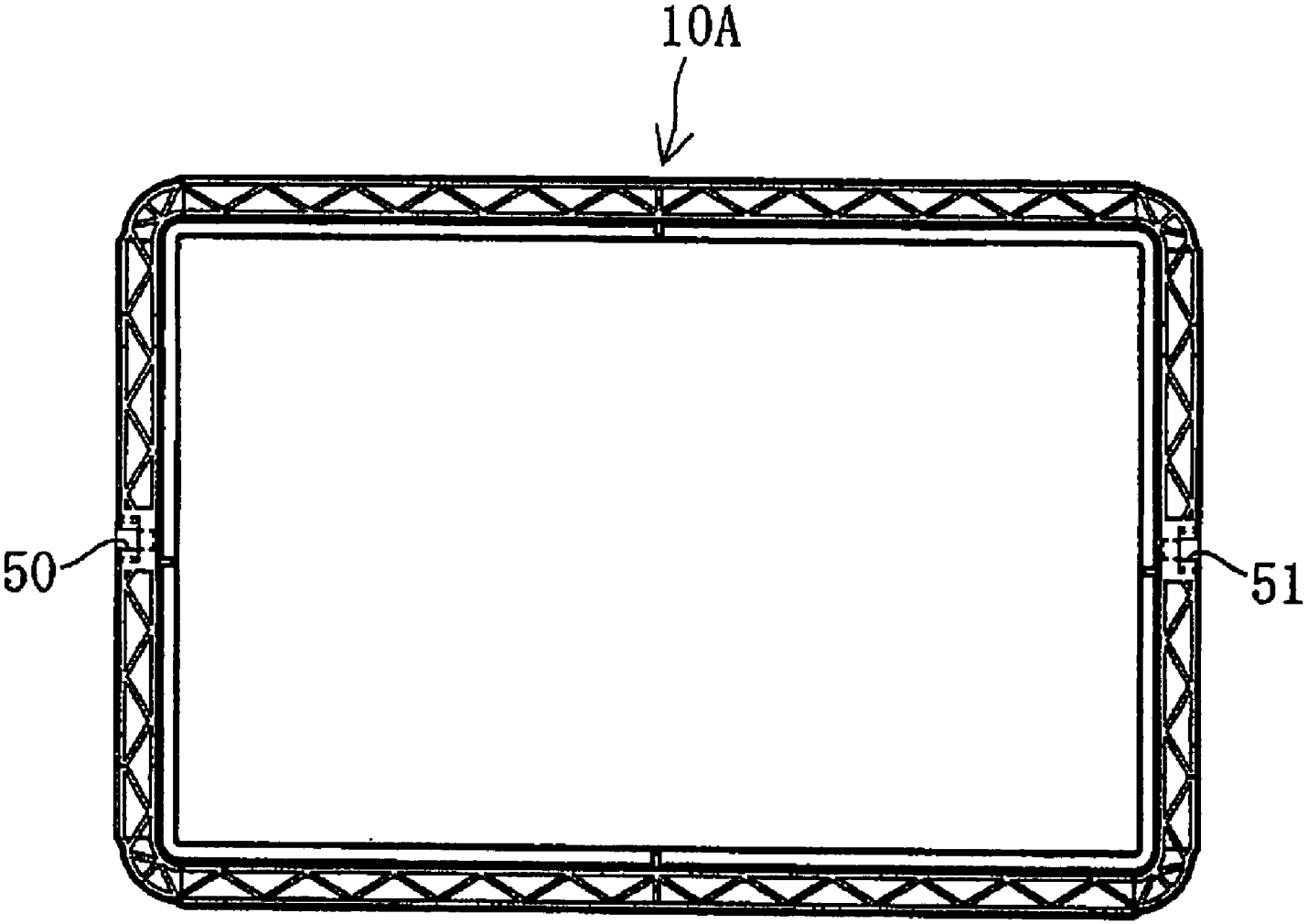
FIG. 9 is a plan view of the upper frame.
Figure 10:
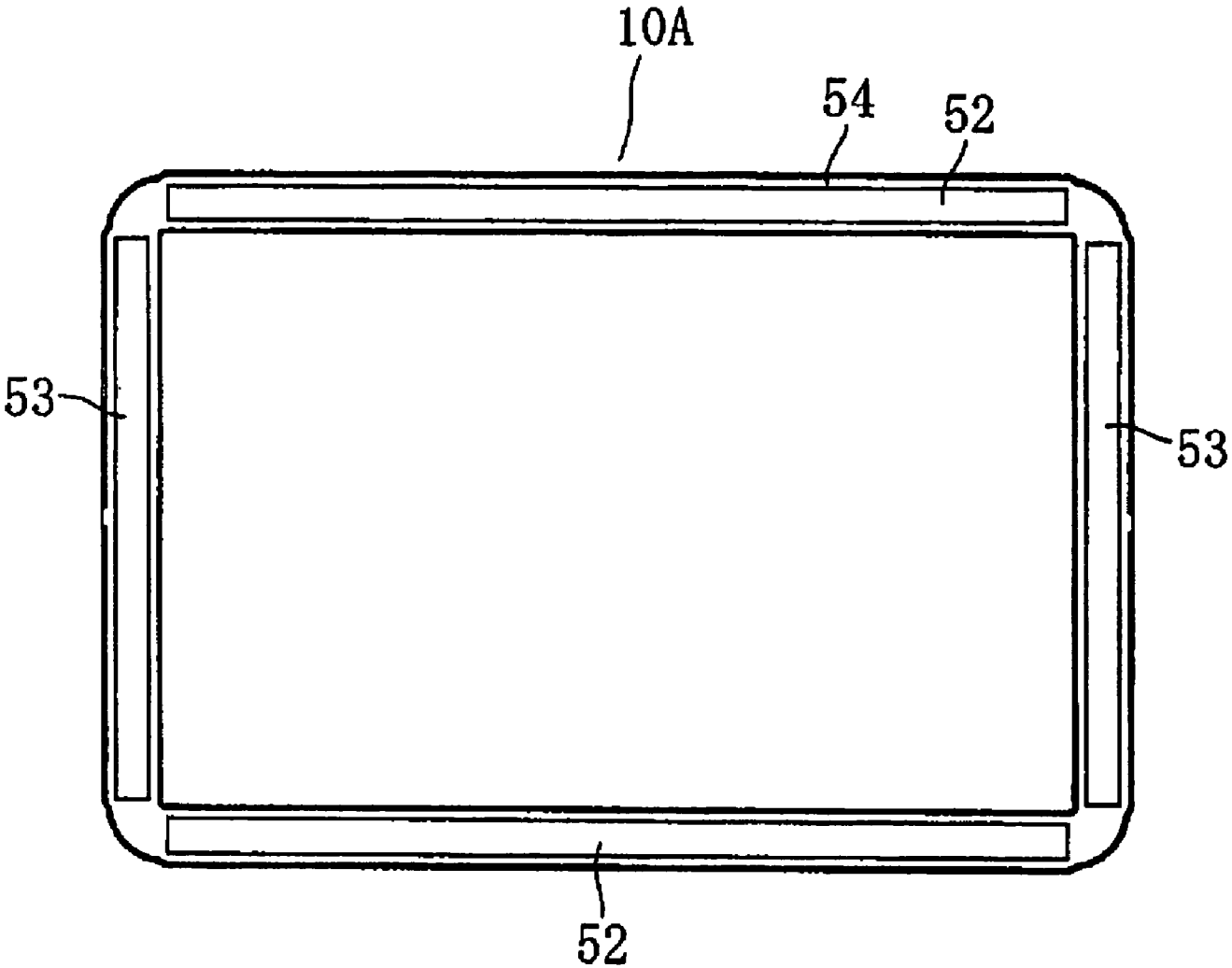
FIG. 10 is a bottom view of the upper frame.

The clamp mechanisms 30R and 30L having the same construction as those in the first example are provided on the lower frame 2A as shown in FIG. 8. However, second support pins 35A are provided on the front ends of the connecting members 31 so as to protrude inward, respectively. The second support pins 35A pivotally connect the upper frame 10A to the connecting members 31. The upper frame 10A is also made from a synthetic resin and formed into the shape of a generally rectangular frame which extends along the holding plate 2*a* and is accordingly smaller than the rising wall 2*b*, as shown in FIGS. 8, 9 and 10. Two holding members 52 and 53 are secured (affixed) to the underside (cloth holding surface 54) of the upper frame 10A as shown in FIG. 10. Each holding member is made from a material having a high friction coefficient. As each of the holding members 52 and 53 is employed the thin sheet-shaped pile, abrasive grain sheet and sheet-like urethane foam as in the case of each of the holding members 24 and 25 of the first example. In the thin sheet-shaped pile, plural or a number of pieces of short fiber 26 are transplanted on the base cloth 27. In this case, the short fiber 26 is transplanted so as to be inclined upward and so as to be directed outward from an embroidery-sewable region of the embroidery frame 1A.

Plural types of upper frames 10A having different plate thicknesses are prepared in the second example although not shown in detail. The plate thickness refers to a dimension from the connecting position of the second support pin 35A which will be described later to the underside. Three types of the affixed holding members 52 made from different materials are prepared for each upper frame 10A. Three types of the affixed members 53 made from different materials are also prepared for each upper frame 10A. As a result, one of the upper frames 10A is adapted to be selected according to the thickness and material of the workpiece cloth and attached to the clamp mechanisms 30R and 30L (the second support pins 35A).

Figure 12:
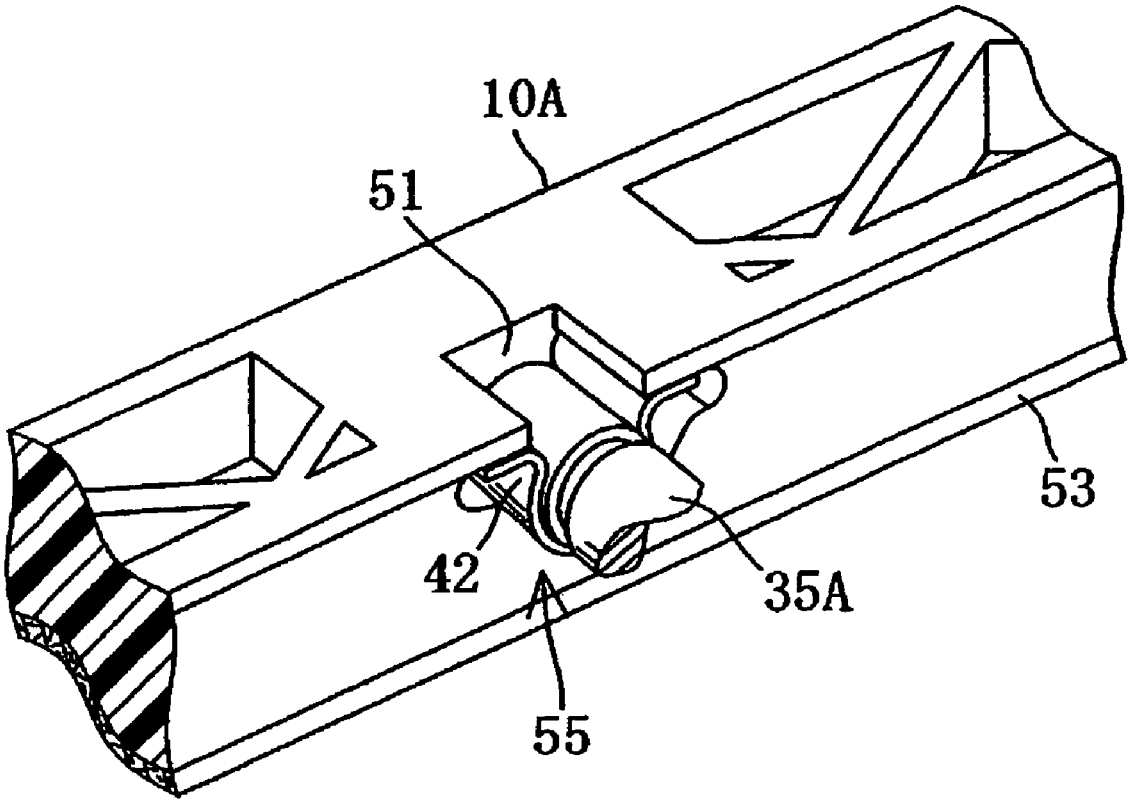
FIG. 12 is a perspective view of the upper frame attaching/detaching mechanism.

The construction of the upper frame attaching/detaching mechanism 55 will now be described. The right and left sides of the upper frame 10A have two spring accommodating recesses 50 and 51 formed in the central parts of the sides respectively as shown in FIG. 12. Each of the recesses 50 and 51 has an upper opening and an outer opening. Two spring members 42 are accommodated in the recesses 50 and 51 which receive the second support pins 35A, respectively. Each spring member 42 is generally formed into the shape of inverted Ω and has an opening which is formed so as to be slightly smaller than the diameter of the second support pin 35A. The opening is slightly spread as the result of elastic deformation such that each support pin 35A is capable of passing through the opening. When the second support pins 35A are inserted into the recesses 50 and 51 (spring members 42) downward from above, the second support pins 35A are supported by the spring members 42, whereby the upper frame 10A is connected to the clamp mechanisms 30R and 30L, respectively. Furthermore, when the second support pins 35A are pulled out of the recesses 50 and 51 (spring members 42), the upper frame 10A is detached from the second support pins 35A.

In the clamp type embroidery frame 1A of the second example, the holding members 52 and 53 each having a high friction coefficient are provided on the cloth holding surface 54 of the upper frame 10A. The upper frame 10A is detachably attached to the clamp mechanisms 30R and 30L. Consequently, one of the upper frames 10A is selected according to the material and thickness of the workpiece cloth, being attached to the clamp mechanisms 30R and 30L. As a result, the workpiece cloths made from various materials can reliably be held between the upper and lower frames. Accordingly, the workpiece cloth can reliably be prevented from being displaced during embroidery sewing such that the embroidery pattern can be prevented from being displaced. Moreover, the construction of the upper frame attaching/detaching mechanism can be rendered simpler and cost-effective in the second example, and the upper frame 10A can easily be attached to and detached from (replaced by) the clamp mechanisms 30R and 30L.

Modified forms of the foregoing examples will be described. The hold assisting member 20 is attached to the lower frame 2 in the first example. However, the hold assisting member 20 may be detachably attached to the cloth holding surface of the underside of the upper frame 10, instead. Two hold assisting members (holding members) may be attached to both upper and lower frames respectively.

The thin sheet-like pile, abrasive grain sheet and sheet-like urethane foam are employed as the holding members 24, 25, 52 and 53 in the foregoing examples. However, the material of the holding member should not be limited to them. For example, rubber, sponge, elastomer, felt or the like may be employed.

The foregoing description and drawings are merely illustrative of the principles of the present disclosure and are not to be construed in a limiting sense. Various changes and modifications will become apparent to those of ordinary skill in the art. All such changes and modifications are seen to fall within the scope of the disclosure as defined by the appended claims.

What is claimed is:

1. An embroidery frame holding workpiece cloth for embroidery sewing, the workpiece cloth having a lower side, the embroidery frame comprising:

a lower frame receiving the lower side of the workpiece cloth and having a cloth holding side;

an upper frame holding the workpiece cloth in cooperation with the lower frame therebetween and having a cloth holding side;

a clamp mechanism having a pair of clamping members pressing the upper frame against the lower frame and retaining the upper frame in a pressing state, such that both clamping members press against a surface of the upper frame; and a hold assisting member provided for enhancing hold of the workpiece cloth and detachably attached to the cloth holding side of at least one of the upper and lower frames.

2. The embroidery frame according to claim 1, wherein the hold assisting member includes an engaging portion for determination of an attachment position, and the lower frame has an engagement hole with which the engaging portion is engaged thereby to be held in position.

3. The embroidery frame according to claim 2, wherein the hold assisting member is selected from plural hold assisting members which are formed into a thin plate shape and have different plate thicknesses.

4. The embroidery frame according to claim 3, wherein the hold assisting member includes a thin base plate having elasticity and a holding member having a function of preventing the workpiece cloth from sliding.

5. The embroidery frame according to claim 4, wherein the holding member comprises a thin sheet-like pile including a piece of foundation cloth on which plural pieces of short fiber are transplanted.

6. The embroidery frame according to claim 5, which has a predetermined embroidery-sewable region, wherein the short fiber is formed so as to be inclined upward and so as to be directed outward from the embroidery-sewable region.

7. The embroidery frame according to claim 4, wherein the holding member comprises an abrasive grain sheet including a sheet-like base material with a surface on which fine abrasive grain is secured.

8. The embroidery frame according to claim 4, wherein the holding member comprises sheet-like urethane foam.

9. The embroidery frame according to claim 2, wherein the hold assisting member includes a thin base plate having elasticity and a holding member having a function of preventing the workpiece cloth from sliding.

10. The embroidery frame according to claim 9, wherein the holding member comprises a thin sheet-like pile including a piece of foundation cloth on which plural pieces of short fiber are transplanted.

11. The embroidery frame according to claim 10, which has a predetermined embroidery-sewable region, wherein the short fiber is formed so as to be inclined upward and so as to be directed outward from the embroidery-sewable region.

12. The embroidery frame according to claim 9, wherein the holding member comprises an abrasive grain sheet including a sheet-like base material with a surface on which fine abrasive grain is secured.

13. The embroidery frame according to claim 9, wherein the holding member comprises sheet-like urethane foam.

14. The embroidery frame according to claim 1, wherein the hold assisting member is selected from plural hold assisting members which are formed into a thin plate shape and have different plate thicknesses.

15. The embroidery frame according to claim 14, wherein the hold assisting member includes a thin base plate having elasticity and a holding member having a function of preventing the workpiece cloth from sliding.

16. The embroidery frame according to claim 15, wherein the holding member comprises a thin sheet-like pile including a piece of foundation cloth on which plural pieces of short fiber are transplanted.

17. The embroidery frame according to claim 16, which has a predetermined embroidery-sewable region, wherein the short fiber is formed so as to be inclined upward and so as to be directed outward from the embroidery-sewable region.

18. The embroidery frame according to claim 15, wherein the holding member comprises an abrasive grain sheet including a sheet-like base material with a surface on which fine abrasive grain is secured.

19. The embroidery frame according to claim 15, wherein the holding member comprises sheet-like urethane foam.

20. The embroidery frame according to claim 1, wherein the hold assisting member includes a thin base plate having elasticity and a holding member having a function of preventing the workpiece cloth from sliding.

21. The embroidery frame according to claim 20, wherein the holding member comprises a thin sheet-like pile including a piece of foundation cloth on which plural pieces of short fiber are transplanted.

22. The embroidery frame according to claim 21, which has a predetermined embroidery-sewable region, wherein the short fiber is formed so as to be inclined upward and so as to be directed outward from the embroidery-sewable region.

23. The embroidery frame according to claim 20, wherein the holding member comprises an abrasive grain sheet including a sheet-like base material with a surface on which fine abrasive grain is secured.

24. The embroidery frame according to claim 20, wherein the holding member comprises sheet-like urethane foam.

25. An embroidery frame holding workpiece cloth for embroidery sewing, the workpiece cloth having a lower side, the embroidery frame comprising:

a lower frame receiving the lower side of the workpiece cloth and having a cloth clamping side;

an upper frame holding the workpiece cloth in cooperation with the lower frame therebetween and having on a cloth holding side a holding member having a function of preventing the workpiece cloth from sliding; and a clamp mechanism having a pair of clamping members independently pressing the upper frame against the lower frame such that each of the clamping members individually and independently press against a surface of the upper frame, thereby holding the upper frame, the clamp mechanism having an upper frame attaching/detaching mechanism to which the upper frame is detachably attached.

26. The embroidery frame according to claim 25, wherein the upper frame is selected from plural of the upper frames having the holding members made from different materials respectively, and the selected upper frame is attached to the upper frame attaching/detaching mechanism.

* * * * *